United States Patent [19]

Doerr et al.

[11] 4,067,610

[45] Jan. 10, 1978

[54] CHAIR CONTROL MECHANISM

[75] Inventors: Wendel P. Doerr, Lexington; William C. Rodgers, Stamping Ground, both of Ky.

[73] Assignee: Hoover Ball and Bearing Co., Saline, Mich.

[21] Appl. No.: 684,731

[22] Filed: May 10, 1976

[51] Int. Cl.[2] ..... A47C 3/00

[52] U.S. Cl. ..... 297/301; 297/332

[58] Field of Search ..... 297/300, 301, 302, 304, 297/305, 333, 332; 248/373; 16/75

[56] References Cited

U.S. PATENT DOCUMENTS

| | | | |
|---|---|---|---|
| 2,784,767 | 3/1957 | Soderberg | 297/301 |
| 3,389,423 | 6/1968 | Johnson | 16/75 |
| 3,601,444 | 8/1971 | Doerner | 297/300 |
| 3,813,073 | 5/1974 | Mohr et al. | 248/373 |
| 3,881,772 | 5/1975 | Mohrman | 297/300 |

FOREIGN PATENT DOCUMENTS

| | | | |
|---|---|---|---|
| 494,427 | 7/1950 | Belgium | 16/75 |

*Primary Examiner*—James T. McCall

*Attorney, Agent, or Firm*—Olsen and Stephenson

[57] ABSTRACT

A control mechanism for a chair having two components which are pivotally movable relative to each other wherein one of the components is the chair seat. The other chair component, in one form of chair such as an office chair, is the seat back. In another form of chair, such as a swivel rocker, the other component is the chair base. The control mechanism includes a torsion bar which has a main body portion that extends front to rear of the seat member, and end portions, one of which is attached to the seat member and the other one of which is attached to the other chair component. During relative pivotal movement of the two pivotally connected chair components, the torsion bar acts as a spring to yieldably resist the pivotal movement and return the chair components to their original positions when the load is removed.

13 Claims, 7 Drawing Figures

CHAIR CONTROL MECHANISM

CROSS-REFERENCE TO RELATED APPLICATION

Application Ser. No. 597,410, filed July 21, 1975 and assigned to the assignee of this application, discloses a chair having a torsion bar which extends front to rear relative to the chair seat.

BACKGROUND OF THE INVENTION

In office-type chairs in which the chair back is tiltable relative to the seat, control mechanisms are utilized to control the rate at which the chair back can be tilted relative to the seat. Torsion bars are commonly utilized in the chair controls to yieldably resist such tilting movement and thus control the rate of tilt. In the past, it has been the practice to mount the torsion bars in horizontal positions in which they extend from side to side with respect to the chair seat. In many cases, it has been necessary to form the torsion bar of a noncircular shape in cross section, such as rectangular, because this shape facilitates mounting of the torsion bar so that it will not be inadvertently rotated.

The prior art devices have been deficient in that they take up substantial vertical space in the chair and thus detract from the chair appearance in profile, they strengthen the chair against side to side movement but do not strengthen the chair in a front to rear direction where the principal load is placed on the chair, they present complicated bearing problems, and inherently make inefficient use of the material from which the chair control mechanism is formed, usually steel. In the case of side to side torsion bars, the torsion bar commonly performs the additional function of an axle which increases the bearing problems.

It is an object of the present invention, therefore, to provide an improved chair control mechanism which is attachable to various types of chairs and utilizes a front to rear torsion bar that can be formed from a round bar.

SUMMARY OF THE INVENTION

The chair control mechanism of this invention has a torsion bar, preferably formed from round stock, shaped so that it has an elongated body portion and a pair of end portions which are substantially perpendicular to the body portion. A torsion bar of this construction is mountable in a chair so that when one of the end portions is restrained against movement and the other end portion is rotated generally about the axis of the body portion, the body portion of the torsion bar will be subjected to a twisting load and the inherent resistance of the body portion to twisting will provide the desired springing action in the chair. This springing action provides the desired yieldable resistance to load when one chair component is moved pivotally with respect to another and, in addition, insures return of the chair parts to their normal positions when the load is removed.

In the mechanism of this invention, a first frame member is secured to the underside of the chair and is arranged in a supporting relation with one end of the torsion bar. A second frame member, pivotally attached to the first frame member, is then secured, in one type of chair to the seat back, and in another type of chair to the chair base. The second frame member is connected to the opposite end portion of the torsion bar so as to cause a twisting of the torsion bar when the frame members are pivotally moved relative to each other. An adjusting member is provided for preloading the torsion bar to adjust the magnitude of the load required to move the frame members relative to each other.

The control mechanism of this invention is advantageous because its makes efficient use of the torsion bar material, simplifies the problem of providing bearings for the torsion bar and enables the frame members to be strengthened in a direction front to rear of the chair seat. Since normal seating loads in the chair are oriented front to rear of the seat member, this strengthening of the mechanism enables use of the mechanism to strengthen the chair. The mechanism requires a minimum of parts and is embodied in a low profile which is advantageous from appearance and efficient use of material standpoints. Furthermore, since the torsion bar extends front to rear of the seat member, it does not also function as the axle about which the frame members rotate, thereby simplifying the construction of the mechanism.

In summary, therefore, the present invention provides an improved control mechanism which is advantageous from the standpoint of performance and ease and economy of manufacture.

Further objects, features and advantages of this invention will become apparent from a consideration of the following description, the appended claims and the accompanying drawing in which:

Figure 1:
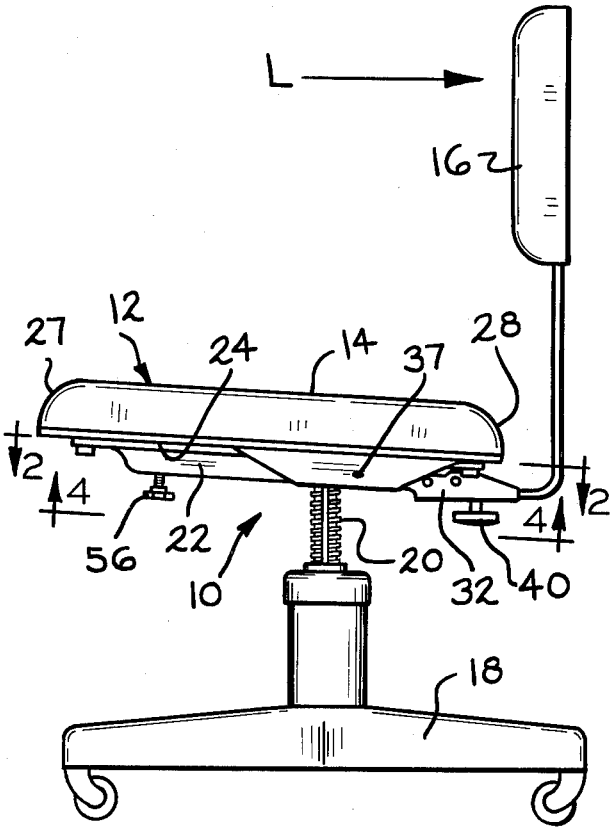
FIG. 1 is a side elevational view of an office-type chair having the control mechanism of this invention incorporated therein.

With reference to the drawing, the control mechanism of this invention, indicted generally at 10, is illustrated in FIG. 1 in assembly relation with an office desk-type chair 12. The chair 12 includes a seat member 14, a back structure 16, a wheeled base 18, and an upright pedestal 20 which extends between the base 18 and the seat 14. In normal use of the chair 12, the seat back structure 16 is tilted rearwardly relative to the seat member 14 and the chair control mechanism 10 yieldably resists this tilting movement for occupant comfort purposes. The mechanism 10 also returns the seat back structure 16 to its upright position when the tilting load is removed by the chair occupant.

Figure 3:
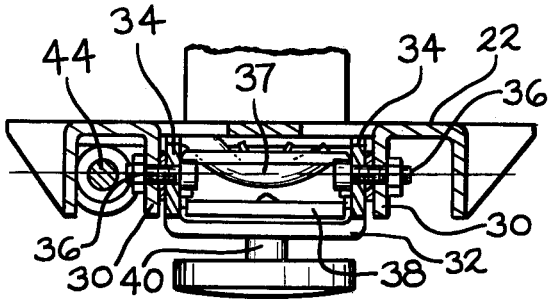
FIG. 3 is a transverse sectional view of the mechanism of this invention as seen from substantially the line 3—3 in FIG. 2.
Figure 2:
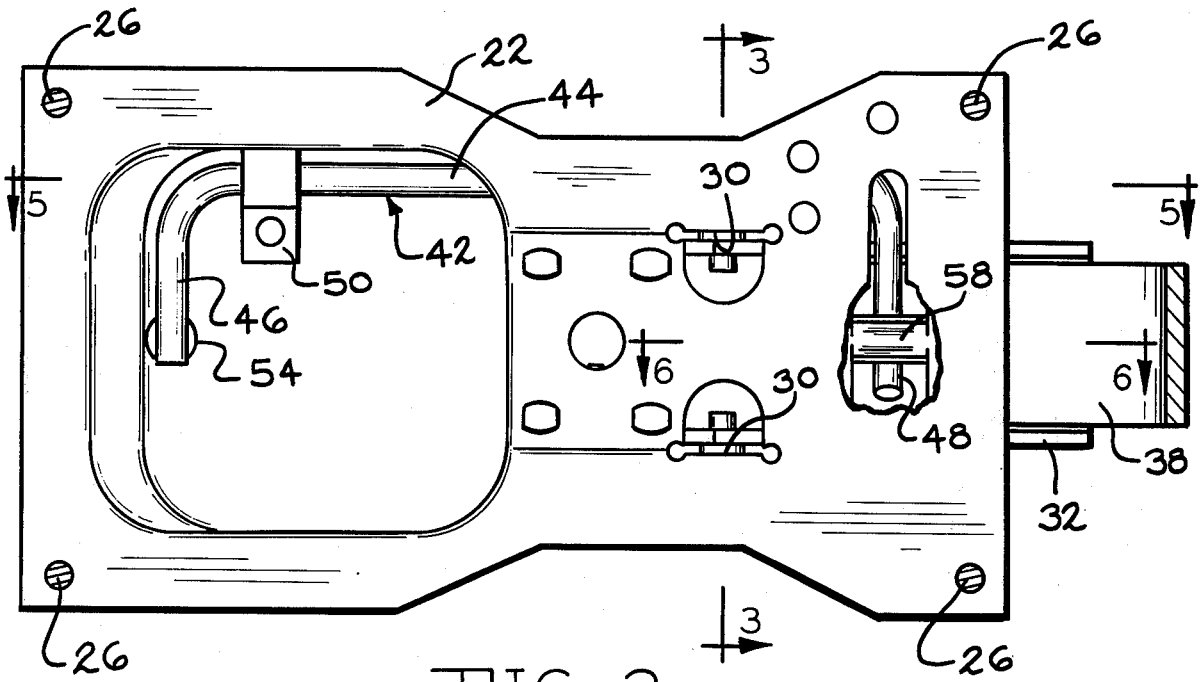
FIG. 2 is an enlarged plan view of the mechanism as seen from substantially the line 2—2 in FIG. 1.
Figure 4:
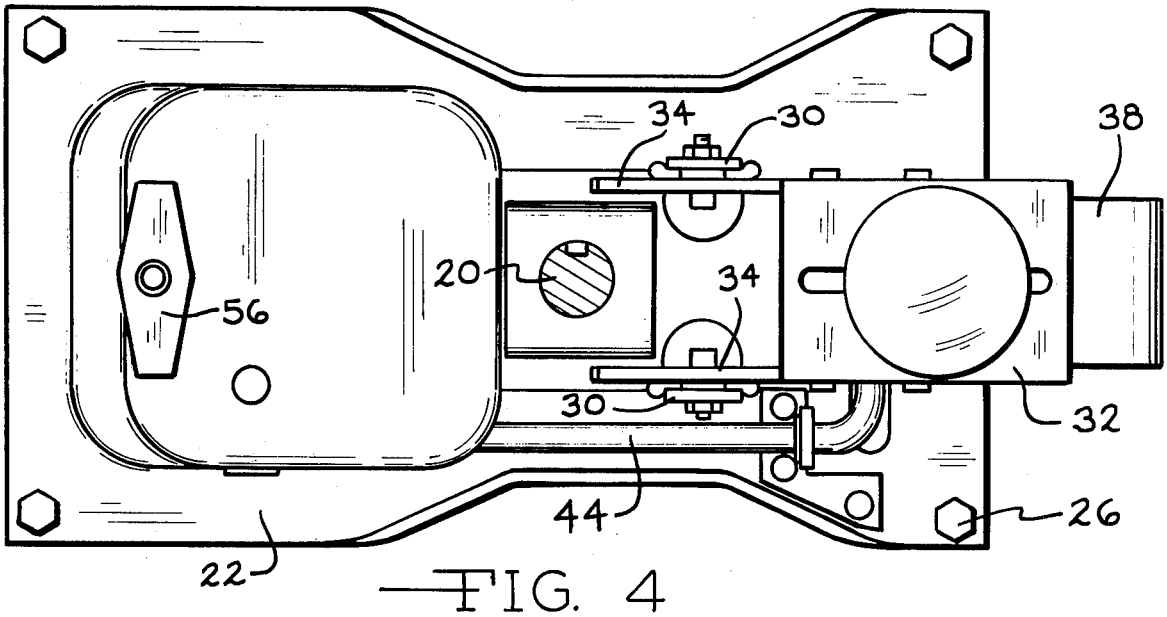
FIG. 4 is an enlarged bottom view of the mechanism of this invention as seen from substantially the line 4—4 in FIG. 1.
Figure 5:
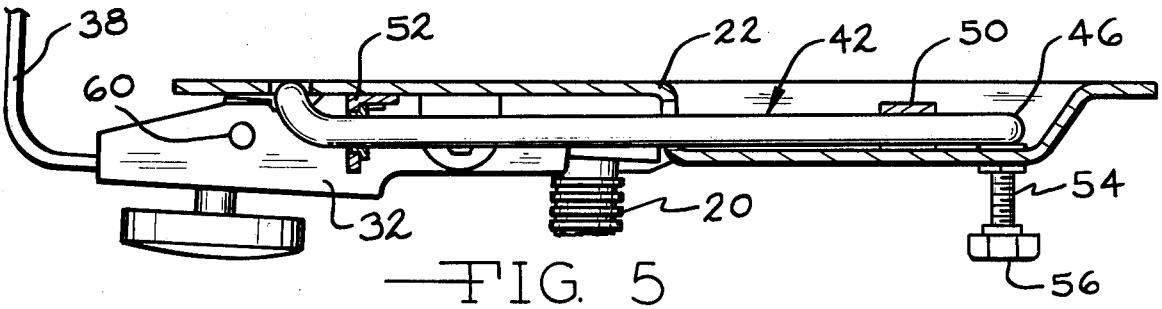
FIG. 5 is a longitudinal sectional view of the mechanism of this invention as seen from substantially the line 5—5 in FIG. 2.
Figure 6:
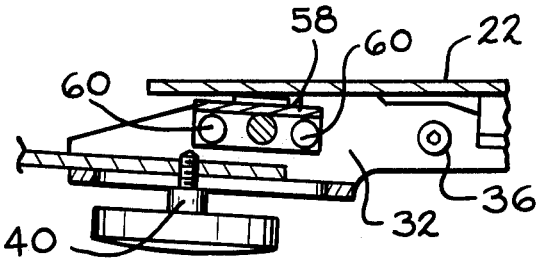
FIG. 6 is a detail sectional view of a portion of the mechanism of this invention as seen from the line 6—6 in FIG. 2.

The chair control mechanism 10 consists of a first or main frame member 22 (FIGS. 1 and 2) which is secured to the underside 24 of the seat 14 by four screws 26. As shown in FIGS. 1 and 2, the seat member 14 has a front end 27 and a rear end 28 and the frame member 22 extends and is elongated in a direction front to rear relative to the seat member 14. Intermediate its ends, the main frame member 22 carries a pair of downwardly extending ears 30 (FIGS. 2 and 3). A second frame member 32, which is of generally U-shape in cross section, has upwardly extending flanges 34 disposed between the ears 30. Aligned bolts 36 extend through the ears 30 and the flanges 34 so as to pivotally connect the frame members 22 and 32 so that they are pivotally movable relative to each other about the axis 37 of the bolts 36. It is to be noted that this axis 37 extends side to side relative to the chair seat member 14. The seat back structure 16 includes a frame portion 38 which is releasable secured to the frame member 32 by a removable screw 40.

It can thus be seen that the mechanism 10 includes a pair of pivotally connected frame members 22 and 32 which are secured respectively to two relatively movable chair components, namely, the seat 14 and the back 16 in the FIGS. 1—6 embodiment of the invention. A torsion bar 42 (FIG. 2) is assembled with the frame members 22 and 32 so as to yieldably resist relative movement thereof in a manner hereinafter explained.

The torsion bar 42 (FIG. 2) has an elongated body portion 44 which extends in a direction front to rear of the chair seat 14 and end portions 46 and 48 which extend at substantially right angles to the body portion 44. The body portion 44 is rotatably supported adjacent its ends in brackets 50 and 52 (FIG. 5) carried by the frame member 22. An adjustable screw 54 having a hand operable head 56, is rotatable mounted on the frame member 22 for engagement with the torsion bar end portion 46 for preloading the torsion bar 42 in a manner to be described in detail hereinafter.

The opposite end portion 48 of the torsion bar 42 is secured to the frame member 32 by a bracket 58 (FIG. 6) secured by rivets 60 to the frame member 32. As a result, pivotal movement of the frame member 32 in a clockwise direction, as viewed in FIG. 1, about the axis 37, in response to application of a rearwardly directed seating load L to the chair back 16 (FIG. 1) causes the torsion bar end portion 48 to be moved downwardly tending thereby to rotate the torsion bar body portion 44 in a clockwise direction as viewed in FIG. 3. Such movement also tends to move the torsion bar end portion 46 downwardly. However, the engagement of the torsion bar end portion 46 with the screw 54 prevents downward movement of portion 46 and prevents the torsion bar body portion 44 from rotating in this direction. As a result, the torsion bar body portion 44 will be twisted between its end portions 46 and 48 by virtue of the relative angular movement of the portions 46 and 48. The yieldable resistance of the torsion bar body portion 44 to twisting deformation will impart to the seat occupant the yieldable resistance in the seat back 16 to the load L which is associated with seating comfort. The magnitude of this resistance can be adjusted by adjusting the screw 54 so as to pre-twist the torsion bar body portion 44 in the direction that it is twisted during application of the seating load L. This is accomplised by manually grasping the screw head 56 and advancing the screw 54 upwardly on the frame member 22. To reduce the preload on the torsion bar 42, the screw 54 is moved in a reverse direction. Any preload on the bar 42 increases the amount of load L necessary to twist the bar 42.

From the above description, it is seen that in the mechanism 10 of this invention the material from which the torsion bar 42 is formed is efficiently used because of the round shape of the torsion bar 42. This round shape can be utilized in the mechanism 10 without creating bearing problems because the torsion bar 42 is independent of the pivot nuts 36 and displaced from the axis 37. This arrangement also enables construction of the mechanism 10 so that it is elongated in a direction front to rear of the seat 14, the same direction in which the chair 12 is loaded during use, thereby enabling utilization of the mechanism 10 to strengthen the chair 12.

Figure 7:
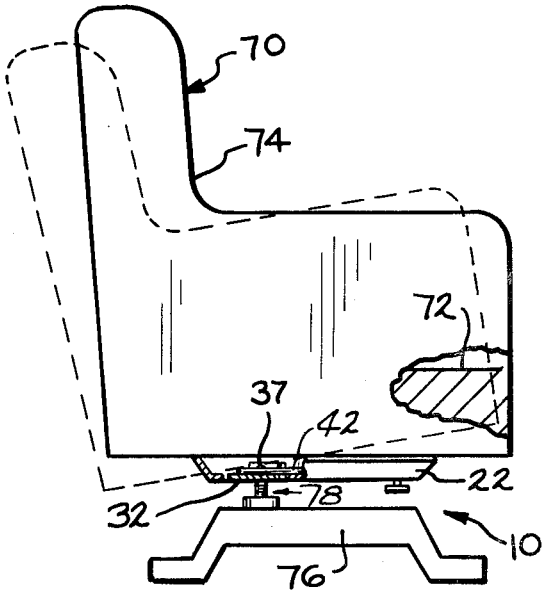
FIG. 7 is a side elevational view of a swivel rocker-type chair showing the mechanism of this invention incorporated therein, and illustrating the chair in a tilted position in broken lines.

The mechanism 10 also has, by virtue of the front to rear orientation of the torsion bar 42, a versatility feature which enables it to be incorporated in other type chairs such as the swivel rocker 70 shown in FIG. 7 which includes a seat 72 and a back 74. In the rocker 70, the mechanism 10 also extends front to rear relative to the seat 72 and is installed so that the frame member 22 is secured to the seat 72 so that it extends in a direction front to rear thereof and the frame member 32 is secured to the chair base 76, which includes conventional swivel mechanism 78. This arrangement of the control mechanism 10 enables the chair 70 to be swiveled horizontally and to be rocked up and down about the axis 37.

What is claimed:

1. A control mechanism for a chair having two components which are pivotally movable relative to each other and wherein one of said components is a seat member having a rear end and a front end, said control mechanism comprising a first frame member mounted on one of said components, a second frame member pivotally connected to the first frame member and mounted on the other component, said frame members being connected for relative privotal movement about an axis, a torsion bar having a main body portion and end portions which are bent transversly of said body portion, said torsion bar being mounted on said frame members so that said body portion extends in a direction substantially perpendicular to said axis and front to rear relative to said seat member, said torsion bar end portions being engaged with said frame members such that on relative pivotal movement of said frame members in one direction of said end portions is moved in a direction tending to rotate said torsion bar body portion in one direction, the other one of said torsion bar end portions being engaged with one of said frame members so as to prevent said rotation and thus cause said torsion bar to twist between said end portions and thereby yieldably resist said relative pivotal movement of said frame members in said one direction and exert forces on said frame members urging said frame members in opposite relative directions.

2. A control mechanism according to claim 1 wherein said torsion bar is substantially round in cross sectional shape.

3. A control mechanism according to claim 1 wherein the other one of said two components is a seat back member.

4. A control mechanism according to claim 1 wherein the other one of said components is a base arranged in a supporting relation with said seat member.

5. A control mechanism according to claim 3 wherein said first frame member is secured to the underside of said seat member, said second frame member is secured to said seat back member, and further including a torsion bar adjustment member mounted on said first frame member and engageable with one of said torsion bar end portions, said adjustment member being operable to exert a force on said one torsion bar end portion capable of preloading said torsion bar to thereby adjust the magnitude of the seating load on said back necessary to twist said torsion bar body portion.

6. In a chair having two components one of which is a seat provided with a rear end and a front end, said components being pivotally movable relative to each other about an axis extending transversly of said seat, a torsion bar having a main body portion and end portions which are bent at substantially right angles relative to said body portion, means mounting said torsion bar on said components so that said body portion extends in a direction front to rear relative to said seat, said end portions being operatively associated with said components such that on pivotal movement of one component in one direction relative to the other component, one of said end portions will be moved in a direction tending to rotate said torsion bar body portion in one direction, said other end portion being engageable with the other one of said components to prevent said rotation and thus cause said torsion bar to twist between said end portions and thereby yieldably resist said pivotal movement of said one component in said direction and exert a force on said one component urging said one component in an opposite direction.

7. The structure according to claim 6 wherein said torsion bar is substantially round in cross-sectional shape.

8. The structure according to claim 6 wherein the other one of said two components is a seat back member.

9. The structure according to claim 6 wherein the other one of said components is a base arranged in a supporting relation with said seat member.

10. The structure according to claim 8 further including adjustable means engaged with one end portion of said torsion bar and operable to preload said torsion bar.

11. A control mechanism for a chair comprising first and second frame members pivotally connected together for relative pivotal movement about an axis, a torsion bar having a main body portion and end portions which are bent transversly of said body portion, said torsion bar being mounted on said frame members so that said body portion extends in a direction substantially perpendicular to said axis, said torsion bar end portions being engaged with said frame members such that on pivotal movement of said first frame member in one direction relative to said second frame member one of said torsion bar end portions is moved in a direction tending to rotate said torsion bar body portion in one direction, the other one of said torsion bar end portions being engaged with said second frame member so as to prevent said rotation and thus cause said torsion bar to twist between said end portions and thereby yieldably resist said pivotal movement of said first frame member in said one direction.

12. A control mechanism according to claim 11 wherein said torsion bar end portions extend in the same direction from said body portion.

13. A control mechanism according to claim 12 wherein said second frame member is substantially rectangular having one elongated edge, said torsion bar being located on said second frame member so that the body portion thereof is adjacent said edge and said end portions extend inwardly away from said edge.

* * * * *